United States Patent [19]

Goss

[11] 4,032,179

[45] June 28, 1977

[54] MACRAME LOOM

[76] Inventor: Paul Thieman Goss, 156 S. Pope St., Louisville, Ky. 40206

[22] Filed: Aug. 13, 1976

[21] Appl. No.: 714,046

[52] U.S. Cl. ..... 289/18

[51] Int. Cl.[2] ..... D03J 3/00

[58] Field of Search ..... 28/15; 289/1, 5, 17, 289/18; 66/4; 139/34; 87/9, 12, 13, 53

[56] References Cited

UNITED STATES PATENTS

| | | | |
|---|---|---|---|
| 248,669 | 10/1881 | Sackett | 28/15 |
| 2,011,617 | 8/1935 | Cottrell | 28/15 |
| 2,703,482 | 3/1955 | Auran | 66/4 |

*Primary Examiner*—Louis K. Rimrodt

[57] ABSTRACT

An apparatus for making macrame including an elongated rod with a plurality of apertures therein, the apertures extending in a plurality of rows longitudinally of the rod with preselected spacings between the apertures. The apertures are adapted for receiving cord securing means therein, the cord securing means generally being hooks or pins to receive cords therearound.

7 Claims, 3 Drawing Figures

MACRAME LOOM

BACKGROUND OF THE INVENTION

This invention relates to hand looms and more particularly to a hand loom device specifically for making articles of macrame.

Many different devices have been devised for retaining thread or cords at spaced distances so that weaving, knotting, or other tying manipulations can be accomplished conveniently. For example, desks for the manufacture of macrame laces have been proposed, such as those disclosed in U.S. Pat. Nos. 248,669 and 254,258. U.S. Pat. No. 248,669 relates to a device for making macrame lace which includes a desk with a plurality of apertures extending along the edge of the top side thereof. On the front side of the desk, a bar is provided which is capable of being set at any point along the edge of the front of the desk for holding threads therein. U.S. Pat. No. 254,258 relates to a device for making macrame lace which includes a desk with a horizontally extending bar having arms at each end thereof adapted to be turned outward for holding threads and also to be folded beneath the desk when not in use. The desk further includes along the borders thereof a plurality of apertures therein to receive pins or hooks. Another macrame desk is disclosed in U.S. Pat. No. 254,288 wherein an elongated bar is provided to extend lengthwise of the board and receive a T-shaped slide thereon which moves freely from one end of the board to the other. U.S. Pat. No. 3,688,357 teaches a device for making macrame which includes a rectangular base member with outwardly extending members at each end thereof protruding normally from the same surface, one of the outwardly extending members being provided with openings therein to receive outwardly protruding pins and the other outwardly extending member being provided with a tie-on bar thereon, the tie-on bar being provided with a plurality of hook shaped members.

Presently, one of the most common ways of making macrame, particularly those designs adapted for receiving potted plants therein wherein the potted plants are hung with hooks from the ceiling, the cord that is to be manipulated is laid out onto a floor and the artisan proceeds to tie the appropriate knots at selected distances. Usually the distances are determined by guess. A second method is to attach a hook to the ceiling and to work downwardly, tying the knots at preselected spacings, the spacings also being determined by guess.

SUMMARY OF THE INVENTION

In the present invention, it is recognized that it is desirable to provide a macrame loom device which is inexpensive, durable and easy to use. Furthermore, it is recognized that it is desirable to provide a macrame loom device particularly of the type utilized as potted plant holders. Even further, it is recognized that it is desirable to provide a macrame loom device which provides means for enabling the artisan to define the spacing between knots of a macrame lace design with little effort.

The present invention advantageously provides a straightforward arrangement for a macrame loom device. The present invention further provides a macrame loom device which is easy to use in making macrame lace designs, particularly those for potted plant holders.

Various other features of the present invention will become obvious to those skilled in the art upon reading the disclosure set forth hereinafter.

More particularly, the present invention provides a macrame loom comprising: an elongated rod having a plurality of apertures therein, the apertures being in a plurality of longitudinally extending rows with preselected spacings between the apertures; and, a plurality of cord securing means received by the apertures, the securing means extending outwardly from the rod to receive cords therearound.

It is to be understood that the description of the examples of the present invention given hereinafter are not by way of limitation and various modifications within the scope of the present invention will occur to those skilled in the art upon reading the disclosure set forth hereinafter.

Referring to the drawings.

Figure 1:
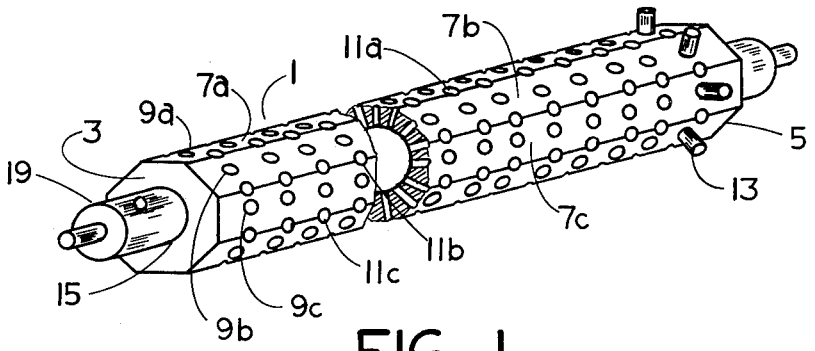
FIG. 1 is a perspective view of a macrame loom device of the present invention.

Referring now to FIG. 1, there is shown a macrame loom device 1 which is an elongated rod of octagonal shape, usually made from wood or a molded plastic, with opposed ends 3 and 5. The octagonal shaped rod has eight faces 7 thereon, the individual faces being designated by the numerals 7*a*, 7*b*, 7*c*, etc. with a row of apertures 9*a*, 9*b*, 9*c*, etc. provided along each face 7, apertures 9 being at preselected distances apart. The rows of apertures 9 on adjacent faces 7 are parallel with the apertures 9 on adjacent rows and are also in alignment and spaced at equidistant intervals from each end. Along the edges of the octagonal shaped member 1 is a plurality of apertures 11, the apertures 11 being spaced in rows at preselected spacings equidistant apart. Furthermore, the apertures 11 are in alignment with the apertures 11 of adjacent apertures 11 along adjacent edges. The apertures 9 and 11 are of substantially the same size and are adaptable to receive a hook or peg 13 therein for receiving a cord 21 therearound.

At each end of the elongated rod 1, ends 3 and 5 are provided with apertures 15 and 17, respectively, therein to receive elongated coupling members 19. Apertures 15 and 17 are of substantially the same diameter as the coupling member 19, the coupling member 19 being generally a cylinder and as shown in FIG. 2 is adapted as the tie-on means for starting and holding in place the cord 21 for the macrame lace design.

Figure 2:
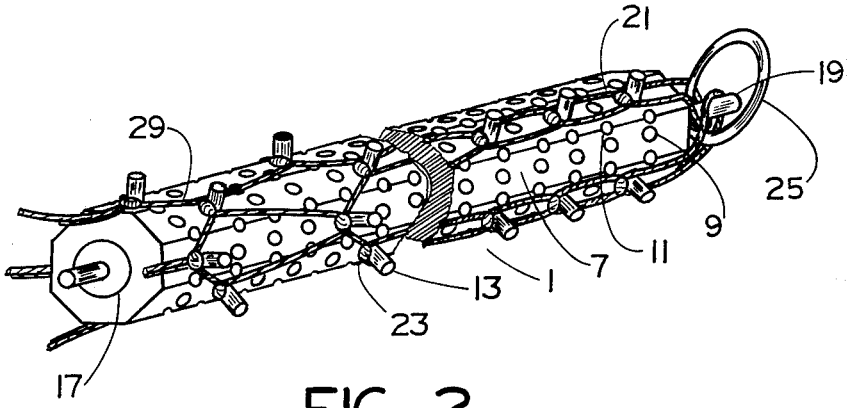
FIG. 2 is a perspective view of the macrame loom device of FIG. 1 when making a macrame design; and, FIG. 3 is a perspective view of a piece of macrame prepared on the macrame loom device of FIG. 1 when the macrame is used as a planted pot holder.

In FIG. 2, a macrame design is shown wherein the cord 21 is brought about the peg 13 and fastened by a conventional self-holding knot, as indicated by the numeral 23. The particular design, as shown in FIG. 2, is determined by the preselected spacings between the pegs 13 and the appropriate knot tied at each spacing.

In making a macrame design, as shown in FIG. 2, a ring 25 is placed over the coupling member 19 and a plurality of cords 21 are placed through the ring 25, each cord 21 being brought down along a row of pegs 13. The cords 21 are looped around the pegs 13 and under tension fastened by a conventional self-holding knot as noted by the numeral 23. The procedure is duplicated as the artisan works down other rows of pegs 13 of the rod 1 with the design being determined by the selection of the pegs 13 and the spacings therebetween.

Figure 3:
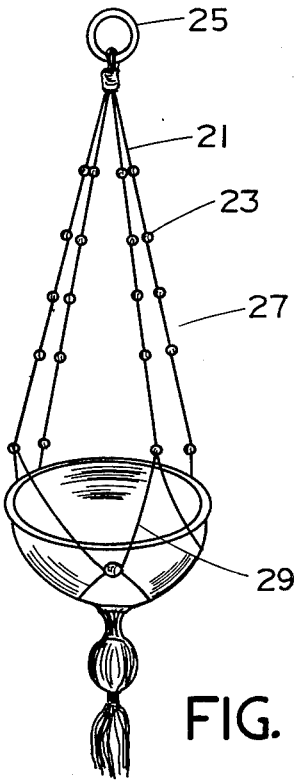

In FIG. 3, the finished macrame lace design of FIG. 2 is shown, the design being a planted pot holder 27. The planted pot holder 27 includes a ring 25 and the cord 21 which includes a plurality of knots 23 therein, the location of the knots 23 being determined by the position of the pegs 13 as shown in FIG. 2. The particular design of the pot holding portion of the design, as indicated by the numeral 29, is also determined by the positioning of the pegs 13 and the tieing of the appropriate knots 23 thereat.

It is realized that the rod 1 may contain any number of sides or may be cylindrical. However, it has been found that a rod with at least six surfaces is preferred.

It will be realized that various changes may be made to the specific embodiment shown and described without departing from the principals and scope of the present invention.

What is claimed is:

1. A macrame loom comprising: an elongated rod having at least six sides, each side having a face thereon with a row of apertures on each face, said rows of apertures on adjacent faces being parallel with said apertures on adjacent rows; a plurality of cord securing means received by said apertures, said securing means extending outwardly from said rod to receive cords therearound; and, coupling means on each end of said elongated rod whereby a plurality of rods may be coupled.

2. The macrame loom of claim 1, said plurality of said longitudinally extending rows of said aperture being at least six, said apertures in alternating rows being in alignment and spaced at equidistant intervals from each end.

3. The macrame loom of claim 1, said cord securing means being pegs.

4. The macrame loom of claim 1, said rod having at least six edges, each edge having a plurality of apertures therealong, said apertures being spaced at preselected spacings equidistant apart.

5. The macrame loom of claim 4, said apertures along each of said edges being in alignment with apertures along adjacent edges and spaced at equidistant intervals from each end.

6. The macrame loom of claim 1, said coupling means including tie-on means for starting and holding in place said cord.

7. The macrame loom of claim 1, said coupling means including apertures in each end of said rod and a cylinder of substantially the same diameter as said aperture in each said end of said rod, said cylinder being received within said apertures of each said end.

* * * * *